United States Patent [19]

Dengel

[11] Patent Number: 4,785,645

[45] Date of Patent: Nov. 22, 1988

[54] KEY RETAINER

[76] Inventor: Donald F. Dengel, 190 East Division St., Fond du Lac, Wis. 54935

[21] Appl. No.: 61,532

[22] Filed: Jun. 15, 1987

[51] Int. Cl.[4] ..... A47G 29/10

[52] U.S. Cl. ..... 70/456 R; 70/457; 70/458; 24/3 K

[58] Field of Search ..... 70/456 R–458; 24/3 K

[56] References Cited

U.S. PATENT DOCUMENTS

| | | | |
|---|---|---|---|
| 1,999,660 | 4/1935 | Mosely et al. | 70/456 |
| 2,006,707 | 7/1935 | Bashara | 70/456 R |
| 2,037,338 | 4/1936 | Rhodes | 70/456 |
| 2,066,526 | 1/1937 | Gladstone | 70/456 R X |
| 2,491,634 | 12/1949 | Auard | 70/456 |
| 2,629,251 | 2/1953 | Schwalberg | 70/457 |
| 2,734,624 | 2/1956 | Kernicki | 70/456 R |
| 2,816,434 | 12/1957 | Olson | 70/457 |
| 2,854,132 | 9/1958 | Bjerknes et al. | 70/456 B |
| 3,119,429 | 1/1964 | Stiller et al. | 70/457 X |
| 3,313,137 | 4/1967 | Maier | 70/456 R |
| 3,394,565 | 7/1968 | Turman | 70/456 R X |
| 3,522,829 | 8/1970 | Weintraub | 70/458 X |
| 3,547,323 | 12/1970 | Suedge, Jr. | 70/456 R X |
| 3,587,262 | 6/1971 | Kaye | 70/456 R |
| 4,037,716 | 7/1977 | Marks | 70/456 R X |
| 4,306,433 | 12/1981 | Kelly | 70/456 R |
| 4,307,590 | 12/1981 | Friedland | 70/456 R |
| 4,637,236 | 1/1987 | Almblad | 70/458 |

FOREIGN PATENT DOCUMENTS

| | | | |
|---|---|---|---|
| 732949 | 4/1966 | Canada | 70/456 R |
| 3037185 | 5/1982 | Fed. Rep. of Germany | 70/456 R |
| 1449928 | 7/1966 | France | 70/457 |
| 635601 | 3/1962 | Italy | 70/456 R |
| 647098 | 10/1962 | Italy | 70/456 R |
| 6504099 | 10/1966 | Sweden | 70/456 R |
| 0626242 | 11/1981 | Switzerland | 70/458 |
| 692747 | 6/1953 | United Kingdom | 70/456 R |
| 845526 | 8/1960 | United Kingdom | 70/457 |
| 2084454 | 4/1982 | United Kingdom | 70/456 R |

*Primary Examiner*—Robert L. Wolfe
*Assistant Examiner*—Suzanne L. Dino
*Attorney, Agent, or Firm*—William D. Stokes

[57] ABSTRACT

A key retainer, primarily having the facility for manually manipulating a key from a stored, inoperative position to a partially stored operation position, is disclosed. The key retainer includes a top planar semi-flexible member and bottom planar semi-flexible member, both of which are joined to one another generally, along their perimeters and vertical center lines, to form two adjacent key storing facilities. Each key storing facility is provided with a key receiving slot for inserting a key within the key storing facility, and a finger-manipulating aperture for manually transferring the key from a stored position to a partially stored operative position through an opening provided in the joining means. A major advantage of the key retaining arrangement, is the absence of key connecting devices usually associated with key retainers.

10 Claims, 2 Drawing Sheets

FIG. 1
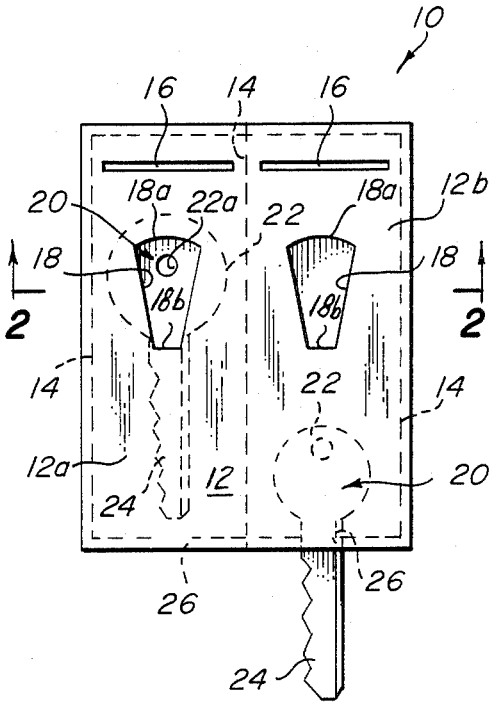
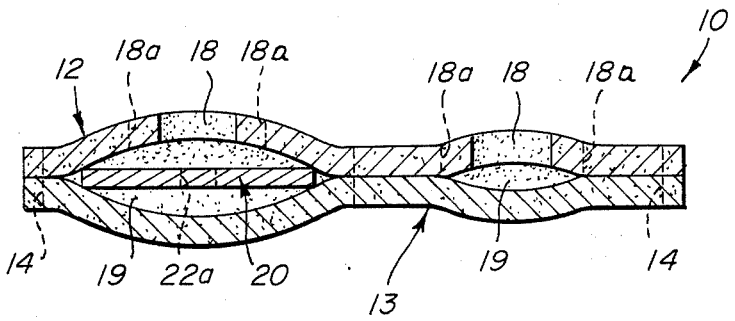
FIG. 2

KEY RETAINER

FIELD OF THE INVENTION

The present invention relates to pocket- or wallet-insertable key holders, retainers and the like, more particularly key retainers of the "ringless" type which include facility for manually manipulating the keys (or key) from stored inoperative positions to partially stored (or attached) locking/unlocking positions.

BACKGROUND OF THE INVENTION

Key retainers, especially those having the capability of being carried within a user's pocket or wallet, have been well known for many years. Other than the use of conventional key rings, usually most of these key retainers are provided with securing means for holding the key(s) in a stored position within a housing or encasement, primarily to prevent the key(s) when placed in a user's pocket, from ripping and puncturing the fabric of the pocket. Generally, the securing means for holding the key in a stored position may also include the facility to manually manipulate or extend the key to a working locking/unlocking position; in other words, the key may be partially withdrawn from the retainer to expose the working end of the key.

Most of these key retainers are equipped with slidable key securing means which permit a user to slide the key from a stored inoperative position to a partially stored (or attached) operative position. Frequently, the key is secured to a recess or channel provided in the retainer's housing via a pin or other securing means, to allow the key to be partially withdrawn from the retainer. For example, the U.S. Pat. Nos. 1,924,134 to Segal; 2,546,413 to Williams; 2,608,851 to Leff; 3,224,052 to Abraham; and 3,315,505 to Shelton, all disclose key retainers including channels, guides or recesses for allowing a key(s) to be transferred from a stored position to a working position. However, while these above-discussed patents show key retainers which operate effectively and without much effort, the keys must be connected to the retainer's channel or guide via some type of connecting means, such as a pin or fastener positioned through the key's typical aperture, for allowing the keys to be manually manipulated or extended to working positions. Due to the construction of this type of key retainer, often times the pins or fasteners become dislodged from the keys (and recesses) especially after long periods of use, causing the keys to be either lost or misplaced from their retainers. In addition, key retainers having slidable key connecting means may be adapted to be carried within pockets, but due to the thickness of the retainer's structure, are not readily insertable within wallets and the like.

The U.S. Pat. No. 2,173,008 to Cheney, shows a key holder of a similar slidable construction, but incorporates a spring-biased device to hold and secure the key within the retainer's channel. However, spring-biased key retainers are difficult to manufacture and require the use of pins or screws to mount the springs to the retainer, the pins or screws frequently being dislodged after extended use of the retainer.

Furthermore, the U.S. Pat. Nos. 2,836,053 and 3,004,422 to Starrett, and 2,897,667 to Taylor, all disclose key holders which utilize pivotal key connecting means for pivotally swinging a key from within its holder to a position of operation. Again, while these patents show key retainers which operate without much effort, the keys must still be secured to the key connecting means via pins, rings or screws, which may have the tendency to be dislodged from the keys after the key holder has been used several times.

Magnetic type key holders have recently been available on the market which magnetically secure a key to the holder. For example, the U.S. Pat. No. 3,680,338 to Lee, discloses a magnetic receptacle for keys, but still requires the utilization of key rings to secure a key within a magnetic channel or recess.

Additionally, attempts have been made in the past to provide a key retainer having the ability to be inserted within the pockets or folds of wallets. Usually most of these retainers are formed of semi-flexible or rigid stiff-like materials for structuring and configuring the retainer to somewhat of a credit card-like appearance, so as to permit the key retainer to be inserted and carried within the pockets and folds of wallets primarily designed for carrying credit cards and the like. The U.S. Pat. No. 2,734,624 to Kernicki, discloses a wallet-insertable key holder formed of molded stiff-like plastic materials, including spaced-apart horizontally extending slits which define regions or bands for retaining keys therein. However, the fact that the keys are not connected to the bands, in other words, the keys are held within the bands only due to the band's tendency to urge the keys against the planar regions of the holder, creates problems of the keys separating from the retainer when sliding a particular key from the holder to a position of operation.

The U.S. Pat. No. 4,037,716 to Marks, shows a similar key retaining device having a generally card-like structure, the retainer being incorporated with a pressure resealable adhesively-coated lid, which retains keys and the like underneath the lid. A major disadvantage of this type of key retaining arrangement is that the lid would have the likelihood of becoming worn, messy and extremely cumbersome after repeated use, and the adhesive employed in this type of key retainer would eventually be exposed to the keys being retained therein, and consequently would contact the hands of the user.

Moreover, no prior key retainer or holder having connection-free key serving means has previously been available, particularly key retainers of this type adapted to be carried within a user's pocket or wallet. There is a great need for a key(s) retainer which can be easily assembled, inexpensively and quickly, and possess the capability of lasting for long periods of use.

SUMMARY OF THE INVENTION

Accordingly, it is an object of the present invention to overcome the deficiencies of the prior art, such as those set forth hereinabove.

It is another object of the present invention to provide the public with improved key carrying retainer.

It is a further object of the present invention to provide a key retainer having connection-free key serving means for holding a key(s) in a stored position, and including the facility for partially removing the key to a working position.

It is yet another object the present invention to provide a key retainer which can be assembled easily, quickly and inexpensively.

It is still another object of the present invention to provide a key retainer having connection-free key securing means, which is readily adapted for insertion within a user's wallet or pocket.

It is still another object of the present invention to provide a key retainer having a substantially stiff card-like structure.

Still other objects, features and attendant advantages of the present invention will become apparent from a reading of the following detailed description of embodiments constructed in accordance therewith, taken in conjunction with the accompanying drawings.

BRIEF DESCRIPTION OF THE DRAWINGS

FIG. 1 is a plan view of an embodiment of a key retainer of the present invention, broken lines, extending generally along the retainer's perimeter and center line, simulating stitched seams;

FIG. 2 is a cross-sectional view of the key retainer of FIG. 1 taken along line 2—2 FIG. 1;

DETAILED DESCRIPTION OF PREFERRED EMBODIMENTS

Figure 3:
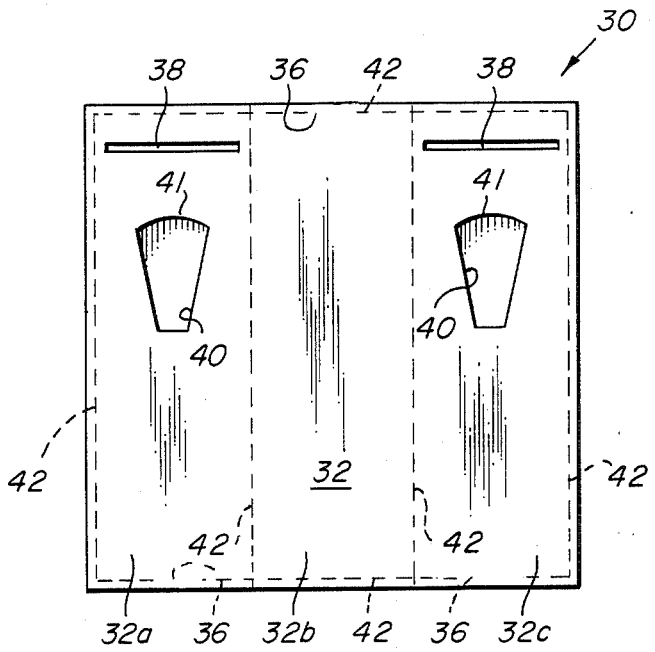
FIG. 3 is a plan view of an alternate embodiment of a key retainer of the present invention, showing the front face thereof.

The preferred embodiment of the present invention is illustrated in FIGS. 1 and 2 of the drawings. The key retainer 10 essentially comprises a top, generally planar, semi-flexible member 12 and a bottom, generally planar, semi-flexible member 13, top and bottom members 12, 13 both having preferably rectangular configurations and substantially equivalent dimensions.

Top and bottom members 12, 13 are adapted to oppose one another and are joined to each other generally along their respective perimeter edges (or borders) and along their respective vertical center lines, through the utilization of stitched seams 14, thus forming two adjacent, generally equivalent-sized, regions 12*a*, 12*b*, which form and define, between the top and bottom members, key storing means 19,19 for holding and retaining keys therein. While it is preferred that the top and bottom members are joined to one another through the use of stitched seams, it should be understood that various other joining techniques could be employed, for example, adhesives, staples, heat-formed seams or any other suitable fastening means, as long as the fastening means facilitates a long-lasting bond or connection to securely hold the top and bottom members together, particularly along their respective perimeter borders and vertical center lines. (Details of the stitching to be discussed later herein.)

Top and bottom members 12,13 are preferably formed of leather or leather-like materials, which possess sturdy yet somewhat flexible properties. However, while the use of leather is preferred, other various materials may be suitably employed, i.e., moldable plastic materials, canvas, rubber products or any other suitable material which has a somewhat resilient yet semi-flexible or semi-rigid characteristic.

Top member 12, overlying each of the key storing means 19,19 is provided with two spaced apart, generally horizontally extending, key receiving slots 16,16 therethrough, for insertion of keys 20,20 into their respective key storing means 19,19. Each key receiving slot 16,16 generally extends near to the entire width of each region 12*a*,12*b*, respectively, and are positioned substantially parallel to the width sides and normal to length sides of the retainer 10. Each key receiving slot 16,16 should have a length large enough to accommodate the circular portion 22 of a key 20, and a width large enough to permit the insertion of various size keys into the key storing means 19,19.

To number 12 also is equipped with finger-manipulating apertures 18,18 therethrough, each of which overlies respective key storing means 19,19. Each finger-manipulating aperture 18,18 is in direct communication with each key storing means 19,19 respectively. Finger-manipulating apertures 18,18 are positioned somewhat near to their respective key receiving slots 16,16 and are of a preferably ice cream cone-shaped configuration. Finger-manipulating apertures 18,18 include an upper curved portion 18*a*,18*a* and a generally truncated-like lower portion 18*b*,18*b*. Each finger-manipulating aperture is generally located half-way between the length side and the center line of the retainer 10 on their respective regions 12*a*,12*b*, finger-manipulating apertures being so positioned, so as to expose a typical key aperture 22*a* and a portion of the key's circular head 22, when the key 20 is inserted and held within the key storing means 19,19. The finger-manipulating apertures should have lengths and widths no longer than the diameter of a conventional key head and thus, prevents a key situated within the key storing means, from accidentally protruding or leaving the key storing means through the finger-manipulating apertures. Preferably, keys held within the key storing means are removed through the key receiving slots 16,16.

Each key storing means 19,19 (or regions 12*a*,12*b*) is equipped with an opening 26, generally formed between the top and bottom members 12,13 and a region absent of stitching, the opening 26 defining a space for manipulating a key's working end 24 therethrough to a position of operation. The key 20 may be moved from a stored inoperative position to a partially stored operative position by simply inserting a thumb or finger within the finger-manipulating aperture 18 to manually manipulate or extend the key to a position of operation, and vice versa. The opening 26 should have a length generally equal to the width of conventional key working ends. Moreover, the openings 26, provided on each lower end of the key storing means 19,19, are generally formed by the absence of stitching 14 provided along the lower width edges or sides of the retainer 10. The openings are substantially positioned in a longitudinal path with the finger-manipulating apertures 18,18, so as to permit easy and direct movement of a key from a position within the key storing means to a partially exposed position through the opening 26, the above-mentioned longitudinal path being substantially parallel to the length sides of the retainer. It should be understood that the openings 26 should not be greater in width than a typical key head, primarily to prevent the key from entirely leaving the key storing means when manually manipulating the key to a position of operation.

In operation, a key to be retained is inserted through the key receiving slot 16 to a position of storage within the key storing means 19. If desired, the working end of the key can be manually manipulated or extended, via finger-manipulating aperture 18, to a position of operation (see the right hand side 12*b* of the key retainer shown in FIG. 1). The key may then be resituated to a position of storage within the key storing means 19 after the key has been used, by simply pushing the working end of the key in a direction parallel to the retainer's length sides.

Figure 4:
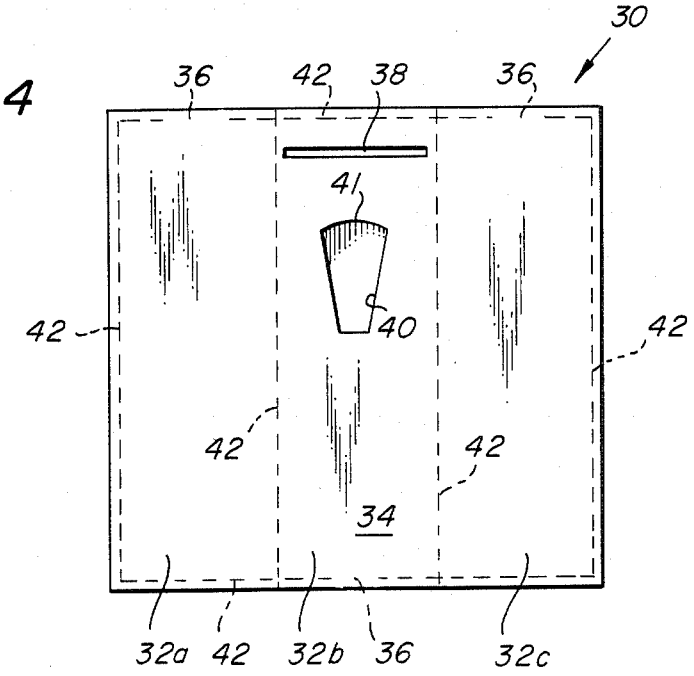
FIG. 4 is a plan view of the alternate embodiment shown in FIG. 3, illustrating the back face thereof.

Referring now to FIGS. 3 and 4 of the drawings, an alternate embodiment of the present invention is shown. The key retainer 30, generally of a 3-fold arrangement, includes a top planar, semi-flexible member 32 and a bottom planar semi-flexible member 34. Both the top and bottom members 32,34 are of identical rectangular configurations and are adapted to oppose one another. Top and bottom members are joined together, via stitching 42, generally along their perimeter edges and along two vertical lines which divide the members 32,34 into three equally-dimensioned key storing facilities **32*a*,32*b* and 32*c*. The two outside key storing facilities 32*a* and 32*c*, include a top number having overlying key receiving slots 38,38 for receiving keys to be positioned within their respective key storing facilities. The top member also is provided with finger-manipulating apertures 40,40 having ice cream cone-shaped configurations 41,41, respectively, each aperture 40,40 being generally positioned in the vertical center of their respective fields 32*a*,32*c*, and are located generally near to and slightly below the key receiving slots 38,38. The bottom number 34 includes, in its central key storing facility 326, a key receiving slot 38, and a finger-manipulating aperture 40,41 (See FIG. 4). While the top member 32 includes stitchless openings 36,36 positioned near the lower edges of the respective key storing facilities 32*a*,32*c*, the bottom member 34 includes a stitchless opening 36 on the edge of the retainer opposing the edge including the other two stitchless openings. Hence, the key retainer shown in FIGS. 3 and 4, offer somewhat of a foldable pocket-insertable key retainer, whereas the preferred embodiment, shown in FIGS. 1 and 2**, shows a wallet—or pocket-inflatable key retainer.

While the key retainer has been shown in a generally rectangular configuration, it should be understood that various other arrangements and configurations are possible. For example, the key retainer may be of a circular configuration or a square structure. The key receiving slots could be of arc-like configuration and the finger-manipulating apertures may be in the form of circles or squares.

Furthermore, the key retainer may include a clip or the like, for fastening the retainer to a belt or the like. Additionally, the retainer could include advertising indicia either on the top or bottom numbers. Also, the key retainer could be assembled to accommodate one key or several keys, depending on users' preferences.

It will be obvious to those skilled in the art that various other changes and modifications may be made without departing from the scope of the invention and the invention is not to be considered limited to what is shown in the drawings and described in the specifications.

What is claimed is:

1. A key retainer, particularly having the facility for manually manipulating keys for stored inoperative positions to partially stored operative positions, comprising:

a first planar member having a first edge and a second edge, said second edge opposing and parallel to said first edge;

a second planar member opposing said first planar ember and having substantially identical size and configuration to that of said first planar member;

joining means, at least along said first and second edges, for joining said first planar member to said second planar member;

key storing means, defined between said first and second planar members and between said first and second edges, for retaining a key positioned therein;

a key receiving slot, integral with said first planar member and positioned parallel and proximate to said first edge, for inserting said key into said key storing means;

an opening, located in one of said first or second edges and defined between said first planar member and said second planar member, for receiving the working end of said key therethrough, said opening being in a direct longitudinal path with said key receiving slot; and a finger-manipulating aperture, integral with said first planar member and positioned between said key receiving slot and said opening, for allowing a user to manually manipulate said key retained in said key storing means to a position of operation through said opening.

2. A key retainer in accordance with claim 1, wherein said first and second planar members consist of semi-flexible material.

3. A key retainer in accordance with claim 1, wherein said finger-manipulating aperture is of an ice cream cone-like configuration having an upper curved portion and a lower truncated portion.

4. A key retainer in accordance with claim 1, wherein said finger-manipulating aperture has a width no greater than the diameter of a conventional key head.

5. A key retainer in accordance with claim 1, wherein said opening has a length no greater than the width of the working end of a conventional key.

6. A key retainer in accordance with claim 1, further including at least three key storing facilities, wherein at least two of said key storing facilities are spaced apart from one another and said third key storing facility being positioned between said first two key storing facilities.

7. A key retainer in accordance with claim 1, wherein said joining means comprises sewn-in stitching.

8. A key retainer in accordance with claim 6, wherein said three key storing facilities are of a three-fold arrangement.

9. A key retainer in accordance with claim 2, wherein said semi-flexible material comprises leather.

10. A key retainer in accordance with claim 1, wherein said key receiving slot has a length no longer than the width of said key storing means.

* * * * *